United States Patent [19]

Day

[11] Patent Number: 4,638,847

[45] Date of Patent: Jan. 27, 1987

[54] METHOD OF FORMING ABRASIVE RESISTANT WHITE CAST IRON

[75] Inventor: Wallace Day, Columbus, Ga.

[73] Assignee: GIW Industries, Inc., Grovetown, Ga.

[21] Appl. No.: 663,669

[22] Filed: Oct. 22, 1984

Related U.S. Application Data

[63] Continuation-in-part of Ser. No. 600,552, Mar. 16, 1984, abandoned.

[51] Int. Cl.[4] ..... B22D 27/00

[52] U.S. Cl. ..... 164/55.1; 164/473; 164/122; 420/14; 420/9; 420/10; 420/11; 420/12

[58] Field of Search ..... 75/123 CB; 148/35, 3, 148/138, 139, 53; 164/55.1, 57.1, 58.1, 473, 122

[56] References Cited

U.S. PATENT DOCUMENTS

| | | | |
|---|---|---|---|
| 3,814,597 | 6/1974 | Sholl | 148/35 |
| 4,221,612 | 9/1980 | Thome | 148/35 |

FOREIGN PATENT DOCUMENTS

| | | | |
|---|---|---|---|
| 53-140218 | 12/1978 | Japan . | |
| 54-41216 | 4/1979 | Japan | 75/123 CB |
| 55-6440 | 1/1980 | Japan | 148/35 |
| 1100200 | 1/1968 | United Kingdom . | |
| 1302321 | 10/1973 | United Kingdom . | |
| 639643 | 12/1978 | U.S.S.R. | 164/58.1 |
| 757604 | 8/1980 | U.S.S.R. | 75/123 CB |
| 850719 | 7/1981 | U.S.S.R. . | |

*Primary Examiner*—Melvyn J. Andrews
*Assistant Examiner*—Deborah Yee
*Attorney, Agent, or Firm*—Newton, Hopkins & Ormsby

[57] ABSTRACT

This invention relates to cast iron and more particularly to the improvement in the toughness and abrasive resistance of white cast iron along with a significant increase in tensile strength. More specifically, the present invention relates to a new white cast iron composition and a process for producing such cast iron having improved toughness, ductility and tensile strength while retaining desirable abrasive resistance through modification of the carbide morphology.

4 Claims, No Drawings

METHOD OF FORMING ABRASIVE RESISTANT WHITE CAST IRON

BACKGROUND OF THE INVENTION

This application is a continuation-in-part of application Ser. No. 600,552 filed 3/16/84, now abandoned.

Alloy white cast iron is well known to be a highly wear-resistant material formed with a carbon content generally recognized to be in excess of 1½% and the capability of being alloyed with other metals, usually chromium, to combine with the carbon to form a compound of iron-chromium carbide such as $M_xC_y$. In many instances, the inherent abrasive resistance of unalloyed cast iron is adequate to meet its intended use and therefore does not pose a problem to the user. However, when the cast iron forming an industrial apparatus is subjected to particular kinds of wear the inherent mechanical properties of cast iron leave much to be desired.

It is well recognized that there are several classifications of wear to which the cast iron material may be subjected. In the first, a gouging or grooving wear, coarse abrasive particles penetrate the working surface of the cast iron to induce a high rate of metal removal. In the typical industrial experience of this type of wear, such as in earth moving equipment, hammermill operations and jaw crushers, there is associated with the metal removal severe shock loading that has been found to have a detrimental effect upon the cast iron.

In another type of wear often referred to as high stress abrasion, abrasive particles, such as may be encountered in a mining operation, are crushed under grinding influence of moving metal surfaces. Stress levels involved in this operative wear process as occur typically in castings used for grinding, crushing rolls or mill liners often exceed the stress capabilities of the conventional cast iron leading to equipment failure.

In the third category of wear, a low stress abrasion or erosion, the abrasive operation to which the cast iron surfaces of the equipment are subjected are not severe stressful conditions, but yet, require high abrasive resistance.

The gouging or grooving wear that is associated with a severe shock load requires a toughness that cast iron typically has not characteristically possessed in the past. A manganese steel with high plasticity and toughness has been able to meet the severe shock resistant requirements for material subjected to this type of wear. However, the hardness and abrasive resistance is usually found to be inadequate to prevent an extremely high rate of wear in the high stress abrasion operation typical in a wide range of pulverizing processes such as a rotary ball mill. In this high stress operation both chrome molybdenum steel and alloyed white iron may be used in various types of apparatus depending upon the requirement of toughness and the combination of abrasion resistance required. In the last category of wear involving low stress operations chromium alloyed irons with or without molybdenum or nickel additions may be used with a desirable high martensitic matrix having a carbide embedment.

A consideration of the categories of wear and the knowledge of the industry concerning the types of metals available to meet the requirements in these wear categories has led to a dilemma to those skilled in the art. To operate apparatus subjected to at least the first two categories of wear there is a clear requirement or combination of optimum wear resistance and sufficient toughness to resist the severe impact and stress conditions characteristic to these types of wear. Hardness and toughness are generally recognized to typically stand at the opposite ends of the spectrum so that those compositions possessing more of one characteristic lose some of the other and yet both hardness and toughness are required.

The industry that supplies abrasion resistant castings has long sought to improve the useful life of the apparatus utilizing the casting in the wear applications described. Various iron carbon compositions alloyed and non-alloyed do not have a high toughness in the martensitic state with the carbon starting as low as 0.04%. Hypereutectoid steels and white irons exhibit insufficient toughness because of the morphology of the cementite ($Fe_3C$). Alloying the iron-carbon composition produces carbides ($M_xC_y$) with increased hardness thus meeting some requirements for greater abrasion resistance. However, while abrasion resistance increases the toughness or resistance to fracture decreases as the carbide volume increases, unless at any given carbide volume the carbide size is decreased. Metallurgists have long recognized the complexity of white cast iron because the two main micro-constituents, the carbide and the matrix act essentially independent of each other. Nevertheless, the ultimate characteristics of the material result from the interdependence between the two components if the white iron is subjected to abrasive and shock conditions. When impact takes place upon such material, the carbides shatter and if the carbides are continuous and of relatively large size the cracks will propagate throughout the structure often leading to failure or at least accelerated wear of the material.

There is thus to date no recognized iron-carbide alloy whose carbon content exceeds 1.7% by weight that meets the requirements of high abrasive resistance and good shock stress absorption.

OBJECTS OF THE PRESENT INVENTION

It is the principal object of the present invention to provide a white cast iron having characteristics of high hardness or wear resistance and improved toughness.

It is further an object of the present invention to provide a white cast iron possessing not only desirable wear resistance and toughness characteristics but also having improved tensile strength.

It is also an object of the present invention to provide a cast iron composition having high abrasive resistance and toughness wherein the carbides are in the form of globules that approach spherical form.

This invention also has a further object, a provision of a cast iron that is tough and wear resistant in which the carbides are of smaller than conventional average size and substantially evenly distributed throughout the matrix.

It is also an object of the present invention to provide for the production of a higher entropy in an alloy cast iron by introducing boron to not only produce globular particles but also smaller average size particles that are more evenly distributed.

It is still a further object of the present invention to provide a tough, wear-resistant cast iron in which a molten cast iron composition is cooled below the equilibrium solidification temperature to a super cooled temperature and thereafter solidified to produce globular shaped carbides having an average size less than the average conventional cast iron carbide particles.

SUMMARY OF THE INVENTION

The present invention is a unique discovery of an alloy cast iron composition comprising as a base the element iron, with or without 0.001% to 30% by weight singly or cumulatively vanadium, titanium, niobium, molybdenum, nickel, copper, tantalum or chromium or mixtures thereof, 2.0 to 4.5% by weight carbon forming an alloy composition and introducing 0.001% to 4.0% by weight boron to improve wear-resistance, toughness and tensile strength properties. The alloy has a solidification point between 2200° F. and 2400° F. and generally is in a range between 2260° F. to 2300° F. This solidification point is within 15° F. of the eutectic temperature of the cast iron with the selected alloying elements. The carbides present in the form of globules that are approaching spherical form and are of a size that average less than 4 microns which is considerably less than the average particle size of carbides in conventional cast iron.

In the process of the present invention an alloy white cast iron containing 0.001% to 30% vanadium, titanium, niobium, molybdenum, nickel, copper, tantalum or chromium or mixtures thereof and 1.8% to 4.5% carbon forming a molten cast iron composition is provided with an entropy increasing additive such as 0.001% to 4.0% boron then cooling the molten cast iron composition at least 5° F. below the equilibrium solidification temperature of between 2200° F. and 2400° F. to a super cooled temperature and thereafter solidifying the molten cast iron composition to produce globular shaped carbides having an average size less than the average conventional cast iron or carbide particle and, on the average, less than 4 microns.

DESCRIPTION OF THE PREFERRED EMBODIMENT

It has been long recognized that white cast iron inherently possesses the wear-resistant characteristics desirable to meet the various wear conditions to which the apparatus composed of cast iron is subjected. It now has been discovered that the carbide morphology of the alloyed cast iron can be altered to retain the characteristic wear-resistance and not only increases the tensile strength but more importantly provides measurable plastic deformation and significant toughness improvement. It has been well known that in the prior cast irons either the free (in excess of that found in the matrix of austenite, pearlite or martensite) carbon was in the form of graphite that takes a three-dimensional form somewhat similar to a cornflake or in the form of a carbide in a plate or rod-like shape. In either form the particles are microscopic in size but usually would be larger than 10 microns for an average particle size assuming normal heat abstraction from a sand mold and a metal section size in excess of 10 mm.

It is known that these graphite flakes are the origin of the fractures along the plane of the flakes. Typically a good grade of cast iron would have a tensile strength of about 50,000 psi with 0% elongation producing a very brittle or non-tough material with no capability of deformation whatsoever. When properly alloyed, the free carbon partitions to an intermetallic metal carbide usually chromium carbide shaped generally in the form of the plates or rods and may be continuous or discontinuous within the matrix but again are of an average size greater than 10 microns. The carbide particles may also take the form of needles but whatever appearance they may hve microscopically, their long dimension on the average is still at least 10 microns which increases the propensity for crack initiation under stress which often leads to an ultimate apparatus failure.

In the present invention it has been found that this normal rod or plate geometry of the carbides can be changed into a globular form that approximates a spherical shape producing not only the desired toughness but a significant tensile strength increase. This change in the morphology of the carbides of cast iron has altered the non-ductile, brittle, non-deformable cast iron of the past to one that has the capability of plastic deformation, higher tensile strength with retention of the superior wear-resistant characteristics.

It has been found, for instance, that the cast iron of the present invention will bend prior to breaking and the stress level to which it is subjected is significantly higher without fracture as compared to prior known cast irons. The cast iron of the present invention is preferably alloyed with chromium but depending upon various additions of vanadium, titanium, niobium, tantalum, nickel, molybdenum or copper from 0.001% to 30% to substitute for the chromium, the properties of the resultant cast iron vary.

In general, the cast iron of the present invention has been found to have a tensile strength as high as 151,000 psi compared to the traditional 50,000 to 60,000 psi tensile strength of prior known cast irons. Typical cast irons have had a 0% elongation characteristic while the present cast iron has a 3% elongation capability. Those skilled in the art would immediately recognize the significant advantages of an increase in elongation or plastic deformation as providing a toughness capability so important in those apparatuses subjected to great wear and shock loading such as, for instance, crushers and pulverizers for the mining industry and also in pumps for the transportation of fluids containing abrasive solids. To achieve only the change in the shape of the carbides in the cast iron would be desirable but not nearly as effective as if the shape of the carbides would change to globules and the particle size was reduced substantially below the typical average 10 to 14 micron size of the particles of prior cast irons down to a size less than 4 microns. By a reduction of this magnitude in the size of the particle of the carbide, it is possible to minimize the mean-free path between the smaller discrete golubar shaped particles in order to contribute to higher strength levels, better wear-resistance and greater deformation capability. Thus, in accordance with the present invention not only are the carbides changed in shape to spherical or near spherically shaped globules, but the globular particles have been reduced in average size to below 4 microns.

Cast iron is well recognized to be an iron-carbon composition that may be alloyed. It is generally recognized in the art that the dividing line between cast iron and steel is the solubility of carbon in iron in the solid state. At higher levels of carbon, the carbon would be in the form of free graphite unless it was alloyed. Typically, the alloying element used to form carbides in cast iron and to improve various properties is chromium. However, molybdenum, vanadium, titanium, copper, nickel, niobium and tantalum in any combination may optionally be added to the chromium or substitute for the chromium. When used in conjunction with chromium these metal elements are usually present in an amount up to about 7% though preferably vanadium or niobium may range from 0.001% to 5%, molybdenum and copper from 0.001% to 4%, nickel from 0.001% to 7% and titanium and tantalum range from 0.001% to 4% with the total in combination with chromium or with chromium alone should be in the range of 0.001% to 30%. Preferably the chromium is in the range of 7% to 29% and more preferably in the range of 25% to 28% or 14% to 22% or 7% to 12% which ranges of chromium represent the three major groups of commercial alloy white irons. The carbon content is preferably not less than 1.8% and no more than about 4.5% and preferably in the range of 1.8% to 3% for cast iron with a content of 25% to 28% chromium and 14% to 22% chromium or 2% to 3.5% for 7% to 12% chromium.

The typical cast iron compositions outlined above can achieve a changed carbide morphology by the addition of boron generally in the range of 0.001% to 4% and preferably 0.01% to 1% and most preferably between 0.01% to 0.4%. This addition of boron is found to produce globular carbide particles but is more pronounced when the alloyed iron-carbon composition selected is related to the eutectic temperature.

The solidification point of pure iron is about 2800° F. and as carbon is added, the solidification point decreases. As alloyed with or without the addition of boron, the solidification temperature varies between 2200° F. and 2400° F. varying primarily in accordance with the amount of chromium present but also varying due to the selection of the particular alloying elements. More desirably it is found that the solidification temperature of the alloyed iron-carbide system should be in the range of 2260° F. to 2300° F. or approximately 2280° F. plus or minus 10° to 20° F. Any specific cast iron composition with the selected alloying elements present in amounts in accordance with this invention will solidify within 15° F. of the eutectic temperature for that system of cast irons formed with those particular alloying elements.

With this alloyed cast iron composition and the addition of boron, it has been found possible to modify the carbide morphology to produce globular carbide particles that are aproximating spherical shape.

To achieve this important particle size modification and to attain a substantially uniform distribution of the globular carbide particles, it has been found that if the cast iron composition were cooled below the equilibrium solidification temperature by at least 5° F., and preferably it is believed 8° to 10° F. or more, prior to solidification that the particle size of the carbide particles would be dramatically reduced from their usual average size of 10 microns or more to an average size of less than 4 microns. This super cooling was found to be difficult to achieve and only upon a thermodynamic approach to the problem was it discovered that by increasing the entropy of the cast iron melt, the disorder of the system is increased to allow the melt to be under cooled. A higher entropy value decreases the Gibbs free energy value of a liquid-solid system, and the phase with the lowest free energy will be the most stable. The relationship is $\pm S$ where G is Gibbs free energy, T is the absolute temperature and S the entropy. Additionally, the thermodynamic relationship $H=T\ S+V\ P$ reduces to $H=T\ S$ because $V\ P=O$ for solids indicates that $S=$ where S is the entropy and H the heat of fusion and T the absolute solidification point. An increase in entropy produces a decrease in the solidification point with a constant heat of fusion for the system.

It was discovered that boron will, when added to the cast iron composition, increase the entropy that produced the higher randomness within the system and allow the requisite under cooling. The exact changes occurring are not completely understood and the explanation as set forth above should be considered to be theoretical.

As the alloy cast iron composition of this invention is cooled below the equilibrium solidification temperature into the super cooling range of at least 5° F. below the equilibrium solidification temperature, when the solidification does occur it is more instantaneous than when super cooling does not take place. Thus, the super cooling avoids the usual lengthy period of crystal or particle growth that conventionally occurs. Rather, the solidification is more rapid before the growth of the particles can be achieved. Thus, the minute carbide particles instead of agglomerating into rods or plates as occurs in the conventional cast iron do not have the opportunity to agglomerate with the rapid solidification in the alloy cast iron composition of the present invention nor is there a migration of these particles to agglomerate to form a plate or rod so as to produce non-uniformity in the distribution of the carbides. Rather, the uniformity in the carbide distribution is inherent in the melt phase even during the super cooling phase of the alloy cast iron composition so that the uniformity of the carbide distribution is retained during solidification. The result of solidification of the super cooled melt below the equilibrium solidification temperature is a substantial reduction in the size of the particle and a more uniform distribution of the carbides throughout the matrix of the cast iron which is the basis for the strength, toughness and abrasion resistance of the cast iron composition of the present invention.

SPECIFIC EXAMPLE

A typical cast iron composition containing 27.2% chromium, 2.04% carbon is an alloy composition with solidification in the range of 2280° F. which is above the eutectic temperature of about 2263° F. With the addition of 0.17% boron the alloy can be super cooled to a temperature of 5 degree below that equilibrium solidification temperature and to about slightly below 2275° F. Between this temperature point and below the equilibrium solidification temperature the melt is super cooled and remains liquid. Further cooling produces carbides having a globular shape that is nearly spherical and of an average particle size of less than 4 microns. The tensile strength of the resulting cast iron is in the range of 151,000 psi with approximately 3% elongation permitted. Such a white cast iron is quite wear-resistant and additionally has improved tensile strength and toughness characteristics that make it particularly useful in high wear and stress operations.

Similar results are obtained with a composition of 3.32% carbon, 9.12% chromium, 5.18% nickel and 0.17% boron having an equilibrium solidification temperature at about the eutectic temperature of 2287° F. Supercooling then takes place down to 2280° F. before solidification occurs.

It is believed that the objects of the present invention have been met by the invention as described above and it is believed that the invention should only be restricted in accordance with the following claims in which

I claim:

1. The process of forming globular shaped carbides in cast iron comprising:

adding 0.001 to 4.0% boron to alloy cast iron comprising 0.001% to 30% vanadium, titanium, niobium, molybdenum, nickel, copper, tantalum or chromium or mixtures thereof and 1.8% to 4.5% carbon to form a molten cast iron composition, cooling said molten alloy cast iron composition below equilibrium solidification temperature to a super cooled temperature, for solidifying said molten cast iron composition to produce globular shaped carbides having an average size less than the average conventional cast iron carbide particle, continuing solidifying said molten cast iron composition by continuing to cool said molten cast iron composition to super cooled temperature to form globular shaped carbides having said average size less than about 4 microns.

2. The process of forming globular shaped carbides in cast iron comprising:

adding 0.001% to 4.0% boron to alloy cast iron comprising 0.001% to 30% vanadium, titanium, niobium, molybdenum, nickel, copper, tantalum or chromium or mixtures thereof and 1.8% to 4.5% carbon to form a molten cast iron composition, cooling said molten alloy cast iron composition below equilibrium solidification temperature to a super cooled temperature, for solidifying said molten cast iron composition to produce globular shaped carbides having an average size less than the average conventional cast iron carbide particle, said cooling of said molten cast iron composition being to a super cooled temperature of at least about 5° F. below the equilibrium solidification temperature, and continuing said solidifying of said molten cast iron composition by continuing to cool said molten cast iron composition to super cooled temperature to form globular shaped carbides having said average size less than about 4 microns.

3. The process of super cooling molten cast iron to improve the toughness and abrasion resistance and tensile strength of cast iron comprising:

increasing the entropy of a molten cast iron mixture of carbon, iron and vanadium, titanium, molybdenum, nickel, copper, tantalum or chromium or mixtures thereof, to form a molten cast iron composition, super cooling the molten cast iron composition to a temperature below the equilibrium solidification temperature of the molten cast iron composition, solidifying said molten cast iron composition while producing globular carbides having an average size less than the average size of the conventional cast iron carbide, continuing cooling said molten cast iron composition by continuing to cool said molten cast iron composition to super cooled temperature to form globular shaped carbides having said average size less than about 4 microns.

4. The process of super cooling molten cast iron to improve the toughness and abrasion resistance and tensile strength of cast iron comprising:

increasing the entropy of a molten cast iron mixture of carbon, iron and vanadium, titanium, molybdenum, nickel, copper, tantalum or chromium or mixtures thereof, to form a molten cast iron composition, super cooling the molten cast iron composition to a temperature below the equilibrium solidification temperature of the molten cast iron composition, solidifying said molten cast iron composition while producing globular shaped carbides having an average size of the conventional cast iron carbide, said cooling of said molten cast iron composition being to a super cooled temperature of at least about 5° F. below the equilibrium solidification temperature, and continuing said solidifying said molten cast iron composition by continuing to cool said molten cast iron composition to super cooled temperature to form globular shaped carbides having an average size of less than about 4 microns.

* * * * *